US007223509B2

(12) United States Patent
Kubo

(10) Patent No.: US 7,223,509 B2
(45) Date of Patent: May 29, 2007

(54) ELECTROPHOTOGRAPHIC TONER

(75) Inventor: Masahiko Kubo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 10/805,206

(22) Filed: Mar. 22, 2004

(65) Prior Publication Data

US 2004/0191657 A1 Sep. 30, 2004

(30) Foreign Application Priority Data

Mar. 24, 2003 (JP) ..... 2003-080855

(51) Int. Cl.
*G03G 9/087* (2006.01)

(52) U.S. Cl. ..... 430/108.4; 430/108.8; 430/109.4

(58) Field of Classification Search ..... 430/108.4, 430/108.8, 109.4
See application file for complete search history.

(56) References Cited

U.S. PATENT DOCUMENTS

| | | | | |
|---|---|---|---|---|
| 5,558,967 | A | 9/1996 | Nagatsuka et al. | |
| 6,436,599 | B1 | 8/2002 | Matsuoka et al. | |
| 2002/0042013 | A1* | 4/2002 | Aoki et al. | 430/111.4 |

FOREIGN PATENT DOCUMENTS

| | | | | |
|---|---|---|---|---|
| JP | 2-32624 | B2 | | 7/1990 |
| JP | 5-197203 | A | | 8/1993 |
| JP | 11-2917 | A | | 1/1999 |
| JP | 11-44969 | A | | 2/1999 |
| JP | 2000267338 | A | * | 9/2000 |
| JP | 2000-284528 | A | | 10/2000 |
| JP | 2000305320 | A | * | 11/2000 |
| JP | 2002-311642 | A | | 10/2002 |
| JP | 2003-66652 | A | | 3/2003 |
| JP | 2003066652 | A | * | 3/2003 |

OTHER PUBLICATIONS

Diamond, Arthur S. (ed.) Handbook of Imaging Materials. New York: Marcel-Dekker, Inc. (1991) pp. 162-165, 168, 169.*

Grant, Roger et al. Grant & Hackh's Chemical Dictionary. New York: McGraw-Hill, Inc. (1987) pp. 8-10, "acid number" and "acid value".*

* cited by examiner

*Primary Examiner*—Christopher Rodee
(74) *Attorney, Agent, or Firm*—Birch, Stewart, Kolasch & Birch, LLP

(57) ABSTRACT

In the toner comprising at least a colorant, a releasing agent and a binder resin, the releasing agent being a mixture of carnauba wax and non-paraffin wax, the binder resin contains a polyester resin comprising a cyclohexane dimethanol of a polyhydric alcohol ingredient as an essential ingredient and having an acid value of 5 to 20 mg KOH/g. An electrophotographic negatively charged full color toner having good fixing property, glossiness, transparency, and releasability without coating a fixing oil to a fixing apparatus.

6 Claims, No Drawings

ELECTROPHOTOGRAPHIC TONER

This Nonprovisional application claims priority under 35 U.S.C. §119(a) on Patent Application No. 2003-080855 filed in Japan on Mar. 24, 2003, the entire contents of which are hereby incorporated by reference.

FIELD OF THE INVENTION

The present invention relates to an electrophotographic toner and more particularly to a toner for use in a full color electrophotography used in image forming apparatus using so-called electrophotography such as electrostatic copying machines or laser beam printers.

BACKGROUND OF THE INVENTION

In the hard copy technique using electrophotography, toners of lower fixing temperature and wider fixing region have been required in recent years for black toners for use in black and white printing in view of the demand for the reduction of energy (saving of power consumption) and high speed operation and simplification and stabilization of fixing systems.

Further, the hard copy technique has been rapidly developed to full color application and, particularly, market for full color products have been extended more and more. In color images by the full color electrophotography, all colors are reproduced generally by using color toners of three colors: yellow, magenta and cyan as three primary colors or using four colors by adding black color thereto. That is, full color images are formed by repeating the process of charging, exposure, development and transfer on every toners described above, forming toner images comprising toners of plural colors on recording media and fusing and mixing toner images (color mixing), thereby fixing them on the recording media.

In the color electrophotography that requires development for several times and super-position of several kinds of toner images of different colors on one identical support as a fixing step, fixing property of color toners is an extremely important factor. That is, a color toner to be fixed should have a wide color reproduction range capable of being fused till the boundary between the toner particles is eliminated thereby providing transparency so that the toner particles do not cause random reflection to light and hinder color reproduction. Further, appropriate glossiness or luster is necessary. Fixing apparatuses used for fixing color toners use rollers made of excellent materials of good surface releasability, and most of them are coated with a great amount of oils on the surface of the rollers, etc. However, coating of a great amount of oils for improving the releasability results in oil stains on transfer paper, increase in the cost and requiring a space for containing oils to bring about problems, for example, of complicating the fixing apparatus or increasing the size thereof.

Oils are generally used for fixing the color toners because it is necessary to increase the heat fusibility more upon heat fixing and lowering the viscosity to provide transparency in black toners for black and white printing. However, toners using such a resin reduce the cohesive force upon heat melting to cause deposition of toners to a heat fixing roller thereby bringing about high temperature offset. Accordingly, in order to prevent the high temperature offset, it is customary to coat oils to the fixing rollers thereby decreasing the depositability of the toners to the fixing rollers.

Then, it has been required in recent years to cope with an oilless mechanism without using an offset preventing effect mechanism by silicon oils with an aim of simplifying the fixing system mechanisms and preventing undesired effects of oils on images (oil stains and stickiness). For this purpose, it has been attempted use of so-called oilless toners not coating oils to fixing rollers that require improvement for the fixing property from low temperature to high temperature, and dispersion of wax into the toner is generally proposed. However, in a case of color toners, since it is necessary that the wax properly exudes from the toner of reduced viscosity as described above, and it is difficult to prevent offset.

JP-B No. 32624/1990 discloses a toner containing a polyester resin and a releasing agent comprising carnauba wax and polyolefin wax. However, since this is a black toner for use in black and white printing, transparency of the toner and fusing compatibility between toner particles are not taken into consideration and this is not sufficient to have a wide fixing region as a color toner.

JP-A No. 2917/1999 discloses a color toner containing a mixture of a plant wax and a synthetic hydrocarbon wax but no appropriate exuding effect of wax from the resin is taken into consideration and the effect thereof is insufficient to provide a wide fixing region at high speed and oilless function.

JP-A No. 284528/2000 proposes to select an olefin polymer having a cyclic structure and high viscosity as a toner binder in order to prevent offset and, further, to use a wax selected from amide wax, carnauba wax, higher fatty acid and ester thereof, higher fatty acid metal soap, partially saponified higher fatty acid ester, higher fatty acid alcohol, polyolefin wax and paraffin wax. However, no appropriate exuding effect of respective waxes from the resins is taken into consideration and the non-offset region is insufficient and impractical.

SUMMARY OF THE INVENTION

The present invention intends to provide a color toner having good fixing property, glossiness, transparency, and releasability without coating a fixing oil to a fixing apparatus. Further it intends to provide a toner of excellent chargeability, fluidity, and storability.

As a result of earnest studies, the present inventors have found that the foregoing subject can be solved in a toner at least comprising a colorant, a releasing agent and a binder resin in which the releasing agent is a mixture of carnauba wax and nonpolar paraffin wax, and the binder resin contains a polyester resin having specified physical property, and have accomplished the present invention.

That is, an electrophotographic negatively charged full color toner according to the present invention at least comprises a colorant, a releasing agent and a binder resin, in which the releasing agent is a mixture of carnauba wax and nonpolar paraffin wax, and the binder resin contains a polyester resin comprising cyclohexane dimethanol as an essential ingredient of a polyhydric alcohol ingredient, and having an acid value from 5 to 20 mg KOH/g.

As a toner fixing method, a heat roll fixing system has been generally adopted so far and various studies have been made therefor. Particularly, in full color toners, resins of low molecular weight are used for extending a color reproducing range and melted till the boundary between toner particles is eliminated to provide transparency. Therefore, the viscosity of the toners is lowered, the cohesive force is weakened, and the high temperature offset is apt to happen. Further, it has been required in recent years to cope with an oilless mechanism without using an offset preventing effect mechanism by silicon oils with an aim of simplifying the fixing system mechanisms and preventing undesired effects of oils on images (oil stains and stickiness). Therefore, a further improvement has been required for the fixing property of the toner from low temperature to high temperature.

In view of the above, in the present invention, the following improvements have been adopted for providing toners of a wide fixing region even in a color toner using a resin of low molecular weight to an oilless fixing system.

(1) A polyester resin having good chargeability, releasability, storability, and pigment dispersibility is selected for the resin, the acid value is set to 5 or higher for controlling the compatibility with the wax, and to 20 or less so as to stably keep the circumstantial stability (humidity) and appropriate compatible state.

(2) Further, in a resin containing cyclohexane dimethanol as an essential ingredient of a polyhydric alcohol ingredient, fine crystalline portions are dispersed over the entire resin. Since high viscoelastic portions are formed locally in the toner by using the resin and the local resiliency of the toner can be increased without increasing the viscosity of the toner, a fixing region at high temperature can be extended while maintaining the fixing property of the toner in the low temperature region.

(3) Generally, wax has two types of functions as the fixing property improving effect, that is, an anchoring effect of exuding from the resin already at a low temperature and strengthen the adhesion with paper at low temperature thereby preventing low temperature offset, and an effect that the wax covers the surface of the fixing roller by exudation at high temperature and intrudes between the toner and the fixing roller to lower the deposition between the toner and the fixing roller thereby preventing high temperature offset.

Then, in order to provide the two functions described above efficiently, a mixture comprising nonpolar paraffin wax and carnauba wax in combination is used. This can provide the toner using the low molecular weight resin with an excellent anchoring effect at low temperature and a sufficient effect of preventing high temperature offset.

This is considered to be attributable to that nonpolar paraffin wax of less compatibility exudes already at a low temperature and carnauba wax maintains exuding effect as far as a high temperature region. Further, use of the mixture can provide more excellent fixing property than that when respective useful effects are utilized individually.

Further, when the wax mixture is used, compatibility with the resin is optimized and no large wax lumps due to uneven dispersion are formed. If large lumps are present without optimization, it may deteriorate the charging property of the toner characteristics and cause filming to photosensitive materials or carriers.

In the invention, the mixing ratio between nonpolar paraffin wax and carnauba wax is preferably from 25%:75% to 75%:25%. When the ratios of respective ingredients are less than 25% and more than 75%, versatile effects as the mixture are lost.

Further, in the invention, the penetration of the wax mixture is preferably 3 or less. When the penetration of the wax mixture is greater than 3, fluidity is lowered to deteriorate the chargeability, result in a problem in the storage stability, and lower the pulverization property in the production step.

Further, in the invention, the range for the DSC peak temperature of the wax mixture is preferably from 70° C. to 100° C. When the DSC peak temperature of the wax mixture is lower than 70° C., the storability is worsened. On the other hand, when it is higher than 100° C., the exuding effect is lowered to worsen the fixing property.

Further, in the invention, the melting temperature of the binder resin is preferably from 95° C. to 125° C. When the melting temperature of the binder resin is lower than 95° C., toner cohesion force is decreased to cause high temperature offset. When it is higher than 125° C., it is not possible to provide a sufficient transparency by eliminating the boundary between the toner particles.

Further, in the invention, the addition amount of the wax mixture is preferably within a range from one part to 10 parts based on the entire amount of the toner. When the addition amount of the wax mixture is less than one part, the wax effect cannot be obtained. On the other hand, when it is 10 parts or more, this deteriorates the chargeability, etc.

DETAILED DESCRIPTION OF THE INVENTION

The colorant in the toner of the invention can include various colorants in accordance with desired colors such as yellow (Y), magenta (M), cyan (C), and black.

Colorant for use in yellow (Y) toner can include, for example, C. I. pigment yellow 1, C. I. pigment yellow 5, C. I. pigment yellow 12, C. I. pigment yellow 15, C. I. pigment yellow 17, C. I. pigment yellow 180, C. I. pigment yellow 93, and C. I. pigment yellow 74 classified by color index, inorganic pigments. such as yellow iron oxide and loess. Further, dyes can include, for example, nitro dyes such as C. I. acid yellow 1, and oil soluble dyes such as C. I. solvent yellow 2, C. I. solvent yellow 6, C. I. solvent yellow 14, C. I. solvent yellow 55, C. I. solvent yellow 19, and C. I. solvent yellow 21.

Colorant for use in magenta (M) toner can include, for example, C. I. pigment red 49, C. I. pigment red 57, C. I. pigment red 81, C. I. pigment red 122, C. I. solvent red 19, C. I. solvent red 49, C. I. solvent red 52, C. I. basic red 10, and C. I. disperse red 15.

Colorant for use in cyan (C) toner can include, for example, C. I. pigment blue 15, C. I. pigment blue 16, C. I. solvent blue 55, C. I. solvent blue 70, C. I. direct blue 25, and C. I. direct blue 86.

Carbon black is preferably used for black. Any of dyes and pigments known so far can be used.

Further, the colorant is contained preferably by 1 to 30 parts by weight and, more preferably, 2 to 20 parts by weight based on 100 parts by weight of the binder resin.

The polyhydric alcohol ingredient constituting the polyester resin used as the binder resin in the toner of the invention comprises cyclohexane dimethanol as an essential ingredient and other alcohol ingredient, preferably, 2 mol ethylene oxide adduct or 2 mol propylene oxide adduct, particularly, 2 mol ethylene oxide adduct of bisphenol A. Other alcohol ingredients that can be used together can include dihydric alcohols such as ethylene glycol, triethylene glycol, 1,2-propylene glycol, 1,3-propylene glycol, 1,4-butanediol, 1,3-butanediol, 1,4-butenediol, 1,5-pentanediol, 1,6-hexanediol, and hydrogenated bisphenol A, and tri- or higher hydric alcohols such as glycerin, trimethylol ethane, trimethylol propane, trishydroxyethyl isocyanurate, and pentaerythritol.

The polybasic acid ingredient constituting the polyester resin used as the binder resin in the toner of the invention can include dibasic acids such as succinic acid, adipic acid, sebacic acid, azelaic acid, dodecenyl succinic acid, n-dodecyl succinic acid, malonic acid, maleic acid, fumaric acid, citraconic acid, itaconic acid, glutaconic acid, cyclehexane diarboxylic acid, ortho-phthalic acid, isophthalic acid, and terephthalic acid, tri- or higher basic acids such as trimellitic acid, trimetinic acid, and pyromellitic acid, and anhydrides and lower alkyl esters thereof, terephthalic acid or lower alkyl esters thereof being preferred with a view point of heat resistant and cohesive property.

For the binder resin in the toner of the invention, the polyester resin can be used also being blended with other resins, for example, styrene acrylic resins, epoxy resins, polyester resins, and petroleum resins.

As the nonpolar paraffin wax in the toner of the invention, natural paraffin wax extracted from petroleum can be utilized.

Carnauba wax in the toner of the invention is natural wax collected from carnauba palm. The acid value is typically from 4 to 10 and penetration value is typically 1 or less.

In the toner of the invention, a charge controller may be incorporated with aim of controlling the triboelectric property of the toner. The charge controller for negative charge control can include, for example, oil soluble dyes such as oil black or spiron black, metal-containing azo dye, metal naphthenate salt, metal alkyl salicylate salt, fatty acid soap and resin acid soap. The charge controller is contained preferably by 0.1 to 10 parts by weight and, more preferably, 0.5 to 8 parts by weight based on 100 parts by weight of the binder resin. For yellow, magenta or cyan toner, colorless metal alkyl salicylate salts, etc. are preferred.

Further, the toner of the invention may be incorporated with a surface treating agent with an aim of controlling the toner fluidity and chargeability. The surface treating agent can include, for example, fine vinylidene fluoride powder, fine polytetrafluoroethylene powder, fatty acid metal salt, zinc stearate, calcium stearate, lead stearate, zinc oxide powder, aluminum oxide powder, titanium oxide powder and fine silica powder. The surface treating agent is incorporated by, preferably, 0.01 to 10 parts by weight, more preferably, 0.1 to 5 parts by weight based on 100 parts by weight of the colorant containing resin.

There is no particular restriction on the grain size of the toner and, for example, those of about 3 to 30 μm in average grain size are preferred. Particularly, for obtaining images at high image quality, the grain size is preferably as small as about 9 μm or less and, more preferably, 4 to 9 μm and, further preferably, 5 to 8 μm.

The toner according to the invention can be prepared by preliminarily mixing homogeneously together with colorant, binder resin and, optionally, other additives in a dry blender, super mixer, or ball mill and, further, uniformly melt-kneading the mixture by using a kneader, for example, banbury mixer, roll, single-screw or twin-screw extrusion kneader and then cooling, pulverizing and, optionally, classifying them.

The DSC peak temperature is measured, for example, by DSC 2000 manufactured by Seiko Instruments Inc. As the measuring condition, a process of elevating the temperature from 20° C. to 200° C. at a rate of 10° C. per one minute and then lowering the temperature from 200° C. to 20° C. is repeated twice, and the endothermic peak in the process is measured.

The penetration of the wax is measured according to JIS K 2235-5.4. "Penetration" is a measure of hardness of petroleum asphalt or petroleum wax. It indicates ten times distance (mm) by which a needle under a load of 100 g vertically penetrates a sample whose temperature is maintained at 25° C. in 5 seconds. The greater the value of penetration, the softer the sample.

For the melting temperature of the resin, when measured using flow tester CFT-500 manufactured by Shimadzu Corp. under the conditions at a sample amount of 1.0 g, a die size of 1.0×1.0, an extrusion load of 20 kgf/cm$^2$, a temperature elevation rate of 6° C., a starting temperature at 60° C., and a pre-heating time for 300 sec, the temperature at ½ stroke was defined as a melting temperature.

EXAMPLES

The toner of the present invention is to be described with reference to examples and comparative examples.

Preparation Example of Toner

After homogeneously mixing the following compositions in a super mixer, it was heat melted and kneaded by a twin-screw extruder, and cooled:

Polyester resin (1,4-cyclohexane dimethanol, 2.2 mol ethylene oxide adducts of bisphenol A, terephthalic acid or trimellitic acid anhydride being used together): 100 parts by weight Copper phthalocyanine (Pigment Blue 15): 5 parts by weight, Charge controller (zinc salicylate compound): 2.0 parts by weight, and Wax mixture.

After coarsely pulverizing the thus obtained kneaded product in a cutting mill, it was finely pulverized by a supersonic jet mill, and fine powder of 5 μm or less was removed by a classifier to obtain a classified toner. The grain size was distributed within a range of 5 to 16 μm and the average grain size was 8.0 μm. External additive of hydrophobic silica was added by 0.4% to the classified toner, and mixed in a super mixer to obtain a toner treated by external addition. Then, the toner and the carrier were mixed to prepare a developer. Ferrite particles were used for the carrier and the toner concentration of the developer was set to 4.0%.

Table 1 shows the melt viscosity and the acid value of the polyester resin, and the DSC peak temperature, penetration, mixing ratio, and addition amount of the wax in the toner used for examples and comparative examples.

TABLE 1

| | Polyester resin | | Wax mixture | | | |
|---|---|---|---|---|---|---|
| | Melting temperature (° C.) | Acid value | DSC temperature (° C.) | Penetration | Mixing ratio* | Contained parts |
| Ex. 1 | 108 | 5 | 75 | 1 | 50 | 3 |
| Ex. 2 | 108 | 12 | 75 | 1 | 50 | 3 |
| Ex. 3 | 108 | 20 | 75 | 1 | 50 | 3 |
| Ex. 4 | 108 | 12 | 70 | 1 | 50 | 3 |
| Ex. 5 | 108 | 12 | 100 | 1 | 50 | 3 |
| Ex. 6 | 125 | 10 | 75 | 1 | 50 | 3 |
| Ex. 7 | 95 | 11 | 75 | 1 | 50 | 3 |
| Ex. 8 | 108 | 12 | 78 | 1 | 75 | 3 |
| Ex. 9 | 108 | 12 | 72 | 1 | 25 | 3 |
| Ex. 10 | 108 | 12 | 75 | 1 | 50 | 1 |
| Ex. 11 | 108 | 12 | 75 | 1 | 50 | 9 |
| Ex. 12 | 108 | 12 | 73 | 3 | 50 | 3 |
| Comp. ex. 1 | 110 | 3 | 75 | 2 | 50 | 3 |
| Comp. ex. 2 | 110 | 22 | 75 | 2 | 50 | 3 |
| Comp. ex. 3 | 108 | 12 | 67 | 4 | 50 | 3 |
| Comp. | 108 | 12 | 105 | 1 | 50 | 3 |

TABLE 1-continued

| | Polyester resin | | Wax mixture | | | |
|---|---|---|---|---|---|---|
| | Melting temperature (° C.) | Acid value | DSC temperature (° C.) | Pen-etra-tion | Mixing ratio* | Contained parts |
| ex. 4 | | | | | | |
| Comp. ex. 5 | 128 | 11 | 75 | 1 | 50 | 3 |
| Comp. ex. 6 | 93 | 11 | 75 | 1 | 50 | 3 |
| Comp. ex. 7 | 108 | 12 | 75 | 2 | 80 | 3 |
| Comp. ex. 8 | 108 | 12 | 80 | 1 | 20 | 3 |
| Comp. ex. 9 | 108 | 12 | 75 | 1 | 50 | 11 |
| Comp. ex. 10 | 108 | 12 | 75 | 1 | 50 | 0.5 |

Ex.: Example, Comp. ex.: Comparative Example
*Mixing ratio (nonpolar paraffin wax/carnauba wax: wt %)

[Printing Test]

Not-fixed images were formed by using the 2-component developer obtained as described above in a copying machine AR-S505 manufactured by Sharp Corp. Then, a fixing device (oilless type) of a copying machine ARC-260 manufactured by Sharp Corp. was modified, an external fixing machine capable of freely setting the roller temperature was used, the paper feed rate was fixed to 120 mm/sec and the temperature was changed from 100° C. to 210° C. by 5° C. step.

In this process, an offset phenomenon in which images were re-transferred to not-image areas was observed, and a temperature at which images were not re-transferred was defined as non-offset temperature, which is shown in Table 2.

The image density of fixed images formed at 150° C. was measured by a Macbeth reflection densitometer and images were frictionally rubbed by a sand rubber eraser to the fixed images. After measuring the image density after frictional rubbing, the fixing strength was calculated according to the following equation:

Fixing Strength=(image density after frictional rubbing/image density before frictional rubbing)×100, which is defined as an index for the fixing strength (%), and the values of 80 or more were defined as "good" in view of the melt-mixing property of the particles in the color toner. Table 2 shows the obtained fixing strength.

For the image density of the thus formed fixed images, the difference of density was measured between paper not used for measurement and the white paper portion of the fixed images was measured by a Macbeth reflection densitometer and judged as "good" in a case of 0.005 or less and "bad" in a case of 0.005 or more. Table 2 shows the obtained fogging.

10 g of the toner was placed in a polyethylene bottle and stored at 45° C. for seven days. After allowing it to cool, the toner was taken out of the bottle and the extent of cohesion was visually judged. In a case where lumps were present, they were lightly touched with a finger and judged as "good" where the lumps were disintegrated causing no practical problem and judged as "bad" where hardness was felt. Table 2 shows the obtained storability.

The non-offset region having a range of 60° C. or more was judged satisfactory. Table 2 shows the obtained result.

TABLE 2

| | Non-offset region (° C.) | Fixing strength | Storability | Fogging | Overall evaluation |
|---|---|---|---|---|---|
| Ex. 1 | 110–175 | 83 | Good | 0.003 | Excellent |
| Ex. 2 | 105–195 | 91 | Good | 0.001 | Excellent |
| Ex. 3 | 105–195 | 85 | Good | 0.002 | Excellent |
| Ex. 4 | 105–190 | 90 | Good | 0.002 | Excellent |
| Ex. 5 | 120–185 | 83 | Good | 0.001 | Excellent |
| Ex. 6 | 125–205 | 80 | Good | 0.001 | Excellent |
| Ex. 7 | 105–180 | 93 | Good | 0.001 | Excellent |
| Ex. 8 | 105–175 | 86 | Good | 0.001 | Excellent |
| Ex. 9 | 120–200 | 85 | Good | 0.002 | Excellent |
| Ex. 10 | 125–190 | 86 | Good | 0.001 | Excellent |
| Ex. 11 | 105–195 | 88 | Good | 0.004 | Excellent |
| Ex. 12 | 105–195 | 89 | Good | 0.004 | Excellent |
| Comp. ex. 1 | 115–160 | 86 | Poor | 0.007 | Poor |
| Comp. ex. 2 | 110–155 | 82 | Good | 0.002 | Poor |
| Comp. ex. 3 | 105–190 | 93 | Poor | 0.004 | Good |
| Comp. ex. 4 | 130–185 | 83 | Good | 0.001 | Good |
| Comp. ex. 5 | 135–195 | 75 | Good | 0.002 | Good |
| Comp. ex. 6 | 105–160 | 90 | Good | 0.001 | Good |
| Comp. ex. 7 | 115–170 | 84 | Good | 0.002 | Good |
| Comp. ex. 8 | 130–185 | 78 | Good | 0.001 | Good |
| Comp. ex. 9 | 105–195 | 85 | Good | 0.009 | Good |
| Comp. ex. 10 | 130–180 | 82 | Good | 0.001 | Good |

Ex.: Example, Comp. ex.: Comparative example

As shown in Table 2, satisfactory results were obtained for Examples 1 to 12 as the toners of the invention as shown in Table 2. On the contrary, in Comparative Examples 1 and 2 since the acid value of the resin was out of the range of the invention, no satisfactory results were obtained for the non-offset region as the fixing property. In Comparative Example 3, since the DSC peak temperature of the wax was low, the storability was worsened. In Comparative Example 4, since the DSC peak temperature of wax was high, the exuding effect was poor and no satisfactory results were obtained for the non-offset region as the fixing property. In Comparative Example 5, since the melting temperature of the resin was high, no satisfactory results were obtained for the non-offset region as the fixing property. In Comparative Examples 7 and 8, since the mixing ratio of the waxes was deviated respectively, no wide non-offset region could be obtained. In Comparative Example 9, since the wax content was large, chargeability became instable to cause fogging. In Comparative Example 10, the wax content was insufficient and the fixing property was poor. As described above, those other than the present invention could not provide satisfactory results.

According to the present invention, since the mixture of carnauba wax and nonpolar paraffin wax is used as the releasing agent and a polyester resin having an acid value of 7 to 20 mg KOH/g is used as the binder resin, a color toner having good fixing property, glossiness, transparency and releasability can be obtained without coating a fixing oil to a fixing apparatus.

What is claimed is:

1. An electrophotographic negatively charged full color toner comprising at least a colorant, a releasing agent and a binder resin, the releasing agent being a mixture of carnauba wax and nonpolar paraffin wax, wherein the binder resin contains a polyester resin comprising cyclohexane dimethanol of a polyhydric alcohol ingredient as an essential ingredient and having an acid value of 5 to 20 mg KOH/g, wherein the penetration of the wax mixture is 3 or less as measured in accordance with JIS K 2235-5.4 at a temperature of 25° C., a load of 100 g, and a period of 5 seconds.

2. An electrophotographic negatively charged full color toner according to claim 1, wherein the mixture ratio of nonpolar paraffin and carnauba wax is from 25%:75% to 75%:25%.

3. An electrophotographic negatively charged full color toner according to claim 1, wherein the range for the DSC peak temperature of the wax mixture is from 70° C. to 100° C.

4. An electrophotographic negatively charged full color toner according to claim 1, wherein the melting temperature of the binder resin is from 95° C. to 125° C.

5. An electrophotographic negatively charged full color toner according to claim 1, wherein the addition amount of the wax mixture is within a range from 1 part to 10 parts based on the entire amount of the toner.

6. A electrophotographic negatively charged full color toner according to claim 1, wherein wherein the mixture ratio of nonpolar paraffin and carnauba wax is from 25%:75% to 75%:25%, the penetration of the wax mixture is 3 or less as measured in accordance with JIS K 2235-5.4 at a temperature of 25° C., a load of 100 g, and a period of 5 seconds, the range for the DSC peak temperature of the wax mixture is from 70° C. to 100° C., and the melting temperature of the binder resin is from 95° C. to 125° C.

* * * * *